US009666397B2

(12) United States Patent
Ziegler et al.

(10) Patent No.: US 9,666,397 B2
(45) Date of Patent: May 30, 2017

(54) ELECTRICAL SWITCHING DEVICE AND METHOD FOR SWITCHING THEREOF WITH CONTACT SEPARATION IN THE EVENT OF PROTECTION

(71) Applicant: Tyco Electronics AMP GmbH, Bensheim (DE)

(72) Inventors: Titus Ziegler, Berlin (DE); Thomas Haehnel, Berlin (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 14/413,007

(22) PCT Filed: Jul. 4, 2013

(86) PCT No.: PCT/EP2013/064102
§ 371 (c)(1),
(2) Date: Jan. 5, 2015

(87) PCT Pub. No.: WO2014/006125
PCT Pub. Date: Jan. 9, 2014

(65) Prior Publication Data
US 2015/0170861 A1 Jun. 18, 2015

(30) Foreign Application Priority Data
Jul. 6, 2012 (DE) ..... 10 2012 106 108

(51) Int. Cl.
*H01H 50/16* (2006.01)
*H01H 71/32* (2006.01)
(Continued)

(52) U.S. Cl.
CPC ..... *H01H 50/16* (2013.01); *H01H 3/54* (2013.01); *H01H 71/32* (2013.01); *H01H 77/08* (2013.01);
(Continued)

(58) Field of Classification Search
CPC ..... H01H 71/32; H01H 50/16; H01H 89/08; H01H 3/54; H01H 77/08; H01H 50/546; H01H 51/06
See application file for complete search history.

(56) References Cited

U.S. PATENT DOCUMENTS 4,077,026 A 2/1978 Slade et al.
4,292,611 A 9/1981 Bresson et al.
(Continued)

FOREIGN PATENT DOCUMENTS

CN 1406389 A 3/2003
CN 1774784 A 5/2006
(Continued)

OTHER PUBLICATIONS

International Search Report and Written Opinion issued by the European Patent Office, dated Sep. 18, 2013, for International Application No. PCT/EP2013/064102; 9 pages.
(Continued)

*Primary Examiner* — Mohamad Musleh
(74) *Attorney, Agent, or Firm* — Faegre Baker Daniels LLP

(57) ABSTRACT

The present invention relates to a switching device for opening and closing a load circuit, in particular in an electric vehicle, having at least one switch contact which can be moved from an open position into a closed position and which is held at a distance from a counter-contact in the open position and is in electrically conductive abutment with the counter-contact in the closed position. The invention further relates to a method for switching a load circuit, in particular in an electric vehicle, at least one switch contact being moved from an open position into a closed position and thereby being brought into electrically conductive contact with a counter-contact. In order to provide the most compact, light, cost-effective and reliable switching and separa-
(Continued)

tion unit for load currents, it is provided according to the invention that, in a safety position, the at least one switch contact is held separated from the counter-contact in order to protect the load circuit.

13 Claims, 3 Drawing Sheets

(51) Int. Cl.

| | |
|---|---|
| ***H01H 77/08*** | (2006.01) |
| ***H01H 89/08*** | (2006.01) |
| ***H01H 3/54*** | (2006.01) |
| *H01H 50/54* | (2006.01) |
| *H01H 51/06* | (2006.01) |

(52) U.S. Cl.
CPC ..... *H01H 89/08* (2013.01); *H01H 50/546* (2013.01); *H01H 51/06* (2013.01)

(56) References Cited

U.S. PATENT DOCUMENTS

| | | | | |
|---|---|---|---|---|
| 4,307,358 | A * | 12/1981 | Haury | H01H 71/2409 335/173 |
| 4,491,812 | A * | 1/1985 | Happach | H01H 71/26 335/184 |
| 5,986,528 | A * | 11/1999 | Meier | H01H 1/54 335/129 |
| 6,693,503 | B1 * | 2/2004 | Nguyen | H01H 51/065 335/131 |
| 6,870,450 | B2 | 3/2005 | Bauer et al. | |
| 7,286,030 | B2 | 10/2007 | Janot et al. | |
| 2010/0251853 | A1 * | 10/2010 | Usami | F02N 15/06 74/7 C |

FOREIGN PATENT DOCUMENTS

| | | | |
|---|---|---|---|
| DE | 561053 | A | 10/1932 |
| DE | 10008104 | C1 | 9/2001 |
| DE | 102004062266 | A1 | 7/2006 |
| EP | 2023368 | A1 | 2/2009 |

OTHER PUBLICATIONS

Examination Report dated Mar. 18, 2013, issued by the German Patent and Trademark Office for Application No. 10 2012 106 108.4; 8 pages.

English translation of Office Action issued by the Chinese Patent Office, dated Jan. 14, 2016 for Chinese Patent Application No. 2013800360532; 7 pages.

* cited by examiner

ELECTRICAL SWITCHING DEVICE AND METHOD FOR SWITCHING THEREOF WITH CONTACT SEPARATION IN THE EVENT OF PROTECTION

BACKGROUND OF THE DISCLOSURE

The present invention relates to a switching device for opening and closing a load circuit, in particular in an electric vehicle, having at least one switch contact which can be moved from an open position into a closed position and which is held at a distance from a counter-contact in the open position and is in electrically conductive abutment with the counter-contact in the closed position.

The invention further relates to a method for switching a load circuit, in particular in an electric vehicle, at least one switch contact being moved from an open position into a closed position and thereby being brought into electrically conductive contact with a counter-contact.

Switching devices and methods of the above-mentioned type for switching load circuits are known from the prior art. They are used for repeated switching, for example, in order to be able to separate a battery or an accumulator of an electric vehicle from consumers when they are not in use, or to be able to open the load circuit. The switching devices are consequently generally contactors.

In addition to the contactors, it is necessary to protect load circuits from overload. In particular in electric vehicles, owing to a relatively low internal resistance of the batteries or the accumulators, very high short-circuit currents may occur in the event of the malfunction of a component and in particular involve the risk of fire and are therefore intended to be prevented. Thus, a regular maximum load current may, for example, be up to 200 A, whereas a short-circuit current at from 2000 to 6000 A can exceed the load current by more than ten times.

In order to protect load circuits from short-circuit currents, there are used, for example, in electric vehicles, fuses which, owing to the large tolerance range thereof, can be used only as a back-up fuse. Back-up fuses, for example, in the form of melting fuses, can continuously guide currents at least up to a rated current. When the rated current is greatly exceeded for a specific period of time, it causes a fuse element of the fuse to melt, whereby the load circuit is interrupted and the fuse becomes unusable. The activated and consequently unusable or "burnt-out" fuse must be replaced.

However, the back-up fuses can generally interrupt a load circuit only at currents above a specific multiple of the rated current thereof until a rated breaking current is reached. Consequently, normal fuses cannot be used in a reliable manner in the event of excess currents which are between the rated current strength and the said multiple of the rated current strength up to the rated breaking current.

In the region between the rated current and the multiple of the rated current strength up to the rated breaking current, in which excess currents, for example, of up to approximately 30% of the short-circuit current may occur, it is therefore necessary to use more powerful power contactors which, in the case of electric vehicles, are accommodated, for example, together with the fuse, in a battery separation unit. However, the simultaneous use of fuses and more powerful power contactors increases the mass and costs of the battery units.

Alternatively, line protection switches can be used to separate the battery from the consumers or, in the case of electric vehicles, from the on-board power supply. Owing to the use of the line protection switches and the fuse function which they perform, it is again possible to use lighter and cheaper switching devices for regular switching operations. However, financial expenditure and complexity in terms of weight when line protection switches are used to interrupt short-circuit currents in electric vehicles are currently considerable. For instance, the line protection switches contain an electromechanically activated actuation mechanism and furthermore generally means for extinguishing electric arcs, such as, for example, quenching plates, magnets, blow-out coils and/or hermetically sealed chambers with pressurised gas. Compared with melting fuses, line protection switches at least have the advantage that they are designed for multiple short-circuit current interruption, and consequently can be reset after activation and do not have to be replaced owing to unusability.

SUMMARY OF THE DISCLOSURE

Taking into account the above-mentioned requirements of switching devices or battery separation units and the disadvantages of devices and methods known from the prior art for interrupting load circuits in the event of excess currents, an object of the present invention is to reduce the weight, structural size and costs of the switching devices or battery separation units and at the same time to ensure or even to increase the reliability thereof.

This object is achieved according to the invention for the switching device mentioned in the introduction in that, in a safety position, the at least one switch contact is held separated from the counter-contact in order to protect the load circuit from overload.

In a method mentioned in the introduction, the object is achieved according to the invention in that, in the event of the load circuit becoming overloaded, the switch contact is automatically separated from the counter-contact and moved into a safety position.

The solution according to the invention has the advantage that the at least one switch contact can be used both for switching the load circuit in a normal operating state with currents below the overload and for interrupting the load circuit in the event of an overload. Consequently, the switching device may combine a regular switching and safety function within it. The at least one switching contact can be accommodated in a switch chamber and can be provided with connections and means for extinguishing electric arcs which can be used both in the normal operating state and in the event of protection. The switch chamber and auxiliary extinguishing means may be tailored to the requirements of the extinguishing of an electric arc in the case of an overload or the occurrence of a short-circuit.

The combination of the switching function in the normal operating state and contact separation in the event of an overload in a switching device consequently enables the weight, structural size and costs of the battery unit to be reduced. At the same time, switching functions in the normal operating state or the conventional function of a contactor and the separation function in the event of an overload or the conventional function of a line protection switch (MCB/miniature circuit breakers) can be adapted to each other in an optimum manner, which increases the reliability of the switching device in the event of an overload and facilitates the construction and use of a battery separation unit for a user since he does not have to select and assemble from a plurality of available contactors and line protection switches a combination which is suitable for the respective application.

The safety position may, in addition to the open position and the closed position, therefore involve another position. The switching device may, for example, be driven for switching between an open position and closed position in an electromagnetic manner, pneumatic manner and/or by means of resilient force. Other drive means may be provided in order to achieve the safety position and may also be electromagnetically, pneumatically and/or resiliently driven with, as in the case of the switch contact, elements of the switching device being able to be used together both for opening and closing in the normal operating state and for separating in the event of an overload.

The solutions according to the invention can be supplemented as desired and further improved by the following additional embodiments which are each advantageous on their own.

According to a first advantageous embodiment of a switching device according to the invention, it may be provided that in the open position the at least one switch contact is held at a distance from the counter-contact over a switching path and in that the switching path is increased by a safety distance in the safety position. Consequently, in the normal operating state, a relatively rapid switching between the open position and closed position can be enabled, in which the switching path can be kept as short as possible in accordance with respective requirements. In contrast, in the safety position, the switching path may be increased by the safety distance in accordance with respective requirements in order to enable the most rapid and reliable separation possible of the switch contact and counter-contact. For separation, the switch contact may, for example, be thrown away from the counter-contact, for which the switching path which has been increased by the safety distance can be used.

The safety distance may be greater than the switching path. It can consequently be ensured in particular that for switching, regardless of the open position and closed position of respective drives of the switching device, the switch contact is separated from the counter-contact in the normal operating state, in any case in the safety position. That is to say, a travel of a drive for switching between an open position and closed position in the normal operating state may be smaller than an inversely orientated travel of a drive for moving the switch contact into the safety position, whereby a distance between the switch contact and counter-contact can be increased with respect to the normal operating state in such a manner that it cannot be overcome by the drive for switching between an open position and closed position in the normal operating state.

A distance between the at least one switch contact and the counter-contact may be greater in the safety position than a distance between the at least one switch contact necessary and the counter-contact necessary for extinguishing an electric arc in the event of a maximum possible overload current in the closed position. Consequently, an electric arc which occurs in the event of an overload between the switch contact and counter-contact can be extinguished in a reliable manner, the switching path being able to be kept as short as possible at the same time in the normal operating state.

The switching device may comprise a safety stop which in the safety position limits movements of the at least one switch contact in the direction of the counter-contact. For instance, in the event of protection, a stop which determines the distance between the switch contact and counter-contact can be displaced with respect to the normal operating state as a safety stop for a movable armature or a switching bridge or a switching member of the switching device. The safety stop may keep the switch contact spaced apart from the counter-contact in the safety position.

The switching device may have a separation drive, whose separation force in the safety position acts counter to a closure force for moving the at least one switch contact from the open position into the closed position. In the event of protection, this separation drive may drive the safety stop and thereby the switch contact which may be driven by a switching drive which produces the closure force in the normal operating state. Consequently, the separation drive and switch drive may be sized in accordance with respective requirements.

The separation force may be greater than the closure force. Consequently, in the event of protection, the switch contact may be separated from the counter-contact in an irreversible manner since the switching drive is not in a position to overcome the separation force which is applied by the separation drive and which counteracts or may oppose the switching force.

The separation drive may comprise a resilient element which at least partially produces the separation force. Owing to a resilient element, the separation force can be produced in an abrupt manner. The resilient element may have a path/force characteristic line which corresponds to respective requirements and may consequently bring about the fastest possible acceleration of the switch contact away from the counter-contact into the safety position in order to enable rapid and reliable interruption of the load circuit in the event of protection.

The switching device may be retained by a retention force in a normal operating state in which the switching device can be moved from the open position into the closed position. The retention force may, for example, be applied by a permanent magnet and/or an electromagnet. When the retention force no longer exists or is at least weakened, the switching device may be moved or may jump automatically from the normal operating state into the safety position.

Under voltage in the closed state, at least in the event of an overload, an actuating magnetic field produced by a load current path may have a weakening effect on a retaining magnetic field which produces the retention force. That is to say, an actuating magnetic force produced by the load current path may act counter to the retention force. Consequently, when the load current exceeds a permissible amount or when a defined overload current is reached, the actuating magnetic field may reach a defined actuating magnetic force, which weakens or counteracts the retention force in such a manner that the switching device automatically moves into the safety position. For example, in the normal operating state, the retention force may act counter to the separation force and be greater than the separation force. Consequently, in particular in the case of a permanent separation force, each time the retention force is exceeded by the separation force, a rapid and automatic movement of the switching device into the safety position may be ensured. The use of the load current path for producing the actuating magnetic field consequently constitutes a simple and reliable solution for detecting overload currents.

The switching device may comprise a switching unit for switching between the open position and the closed position and a safety unit for moving into the safety position. The switching and safety unit may be integrated together in the switching device, use the same elements and components of the switching device, but have a separate and consequently redundant functionality when the load circuit is interrupted.

The safety unit may be retained by a magnetic clamp/spring system and/or an electromagnetic coil in a release position, in which the switching unit can be moved from the open position into the closed position. In the release position of the safety unit, therefore, the switching unit may be in the normal operating state. The magnetic clamp/spring system and/or the electromagnetic coil may be held in the release position by the retention force or the retaining magnetic field exceeding the separation force or the actuating magnetic field. To this end, for example, the load current path may be arranged in the or at least in the vicinity of the safety device so that the actuating magnetic field can be at least partially produced by a magnetic stray flux which is brought about by the load current. The switching device can thus be excited by the stray flux to take up the safety position.

That is to say, the retaining magnetic field or the retention force which is applied thereby can retain the safety unit in the release position and the actuating magnetic field can influence the retaining magnetic field in order, in the event of the retaining force generated by the retaining magnetic field being exceeded, owing to the force of the actuating magnetic field and/or the separation force, to move the safety unit from the release position into the safety position. In the event of an overload, the separation force can exceed a retention force which has been weakened by the securing magnetic field.

A contact bridge or a contact member or the shaft thereof may carry the at least one switch contact and a retention stop, the contact bridge being able to be blocked on the retention stop in the safety position. Consequently, a contact bridge can be used both by the switching unit and by the safety unit together in order to move the switching device between the open position and the closed position in the normal operating state or, in the event of an overload, to move the switch contact into the safety position. The retention stop may be arranged in the switching direction upstream of the switch contact, the switching direction being the direction in which the switch contact is moved during movement from the open position into the closed position. Consequently, the safety unit may be integrated in the switching unit by it being able to act on the contact member substantially between the switch contact and the switch drive.

The switching device may be constructed at least partially concentrically relative to the contact member or the shaft thereof. A centre axis of the switching device may extend through the and/or parallel with the contact bridge or a shaft of the contact member. Such a concentric construction may help to produce any switching forces and separation forces in the most linear and mutually parallel manner possible in order to prevent unilateral loads or forces which extend transversely relative to the switching direction and which could lead to unilateral wear or even tilting of movable elements of the switching device.

The above statements relating to switching devices according to the invention substantiate individually and in combination method steps of a method according to the invention for switching a load circuit or opening the load circuit in the event of protection. A person skilled in the art will therefore recognise that, in a method according to the invention for switching and separating the switch contact and counter-contact, the above-mentioned device features of a switching device can be used or reformulated in the form of method steps for carrying out a method according to the invention.

The invention is explained in greater detail below with reference to an embodiment with reference to the appended drawings by way of example. The embodiment is only one possible construction, in which individual features, as described above, can be implemented independently of each other and can be omitted. In the description of the embodiment, features and elements which are the same have been given the same reference numerals for the sake of simplicity.

DETAILED DESCRIPTION OF THE DRAWINGS

Figure 1:
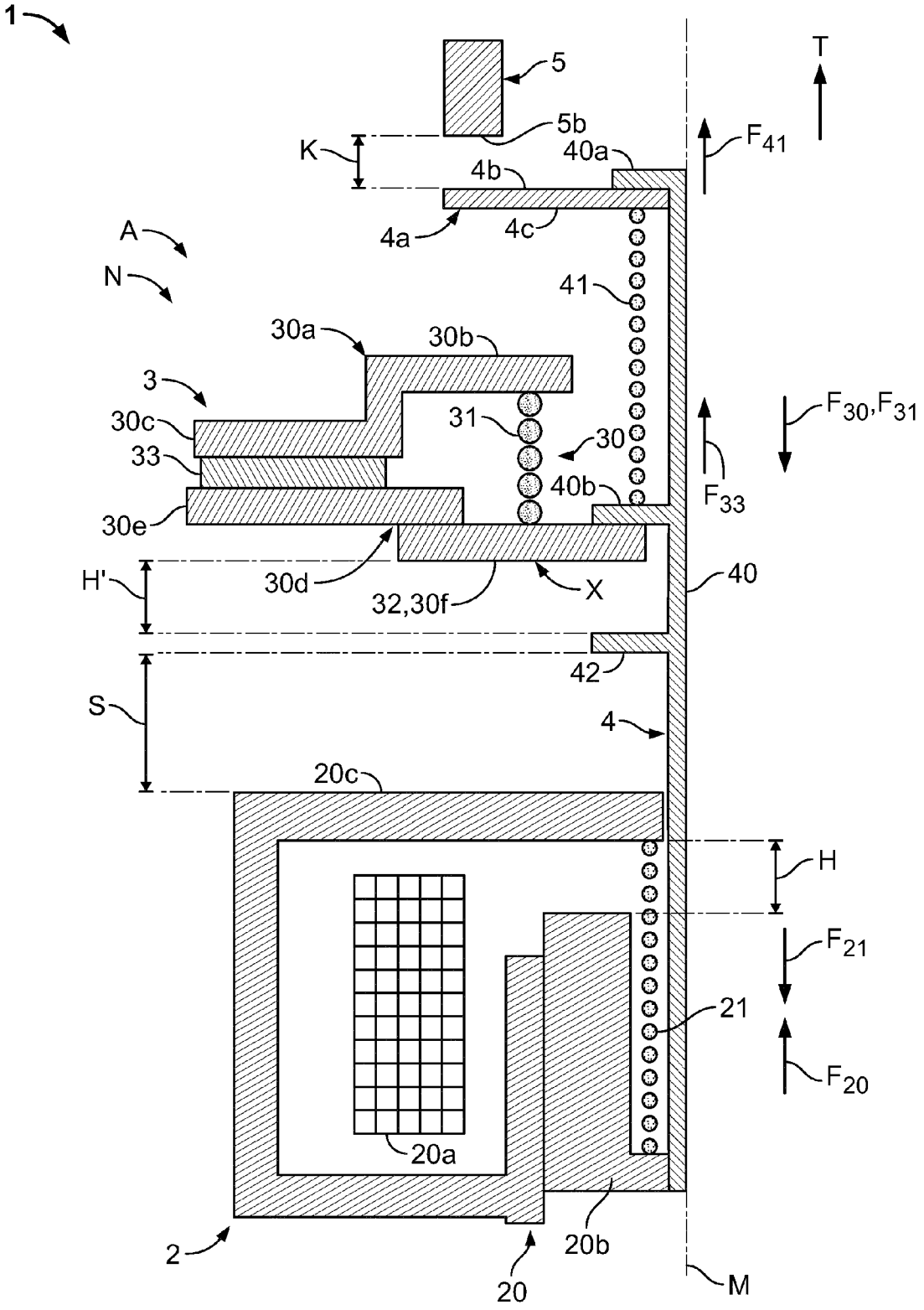
FIG. 1 is a schematic cross-section of a switching device according to the invention in the normal operating state in the open position.

The structure and the operation of a switching device 1 according to the invention are first explained with reference to FIG. 1, which shows the switching device in a normal operating state N in an open position A in a schematic cross-sectional view along the centre axis M thereof. The switching device 1 comprises a switching unit 2 and a safety unit 3 which act on a switching member 4 in the form of a contact bridge. The switching member 4 is constructed so as to be able to be joined together with a counter-contact 5 in a switching direction T.

The switching unit 2 is constructed as a monostable relay or contactor and comprises a coil 20*a* which is arranged concentrically about the centre axis M and which, together with a coil core 20*b* which can be displaced parallel with the switching direction T and which is also arranged concentrically relative to the centre axis M and a yoke 20*c* which predominantly surrounds the coil 20*a* in cross-section externally at the peripheral side, form a switch drive 20 of the switching unit 2. The core 20*b* is arranged so as to be able to be displaced parallel with the switching direction T, supported on the yoke 20*c* in the switching direction T by means of a restoring member 21 in the form of a helical spring which is arranged concentrically about the centre axis M and connected so as to transmit movement or in a rigid manner to a shaft 40 of the switch member 4 at a rear end of the shaft 40. When a control voltage (not shown) is applied to the coil 20*a*, the switch drive 20 produces a switching force or closure force $F_{20}$ which is directed in the switching direction T and attempts to move the core 20*b* together with the switch member 40 counter to a restoring force $F_{21}$ applied by the restoring member 21 in a switching direction T.

The safety unit 3 contains a first yoke 30*a* with a support portion 30*b* and a first magnet closure portion 30*c*. Another yoke 30*d* of the safety device 3 comprises another magnet closure portion 30*e* and a safety stop 32 which is constructed as a movable yoke portion 30*f* or armature. The safety stop 32 is constructed so as to be able to be displaced counter to the switching direction T and is retained in the normal operating state N by a retention force $F_{33}$ which is applied by a retention magnet 33 and which is directed in the switching direction T in the form of a movable yoke portion 30*f* as part of the other yoke 30*d* in a release position X. The yoke 30*a*, the other yoke 30*d* and the retention magnet 33 form a retention member 30 which produces the retention force $F_{33}$. In the release position X, the retention force $F_{33}$ of the retention magnet 33 exceeds a separation force $F_{31}$ applied by a separation drive 31 in the form of a helical spring which is arranged concentrically relative to the centre axis M so that the safety unit 3 remains in the release position X. The separation drive 31 in the form of the helical spring is clamped between the support portion 30*b* and the movable yoke portion 30*f* or safety stop 32.

The switching member 4 has a switch contact 4*a* which is constructed to be in electrically conductive abutment by means of a switch contact face 4*b* with a counter-switch contact face 5*b* of the counter-contact 5. The switch contact 4*a* is arranged at a distal end of a switch contact arm 4*c*, which is supported displaceably parallel with the switching direction T on the shaft 40 of the switch member 4. The switch contact arm 4*c* abuts in the open position A a switch stop 40*a*, which is secured to the shaft 40 and/or is formed thereon. The switch contact 4*a* is clamped between the switch stop 40*a* and a resilient element 41 in the form of a helical spring which is arranged concentrically relative to the shaft 40 or the centre axis M. Counter to the switching direction T, the resilient element 41 rests on an abutment 40*b* which is fitted to the shaft 40 and/or formed thereon in the form of another stop so that the resilient element 41 applies a damping force $F_{41}$ directed in the switching direction T to the switch contact arm 4*c* and presses it against the switch stop 40*a*. There is further formed on the switch member 4 a retention stop 42 which may be constructed in the same manner as the switch stop 40*a* and the abutment 40*b* as a disc which is formed in an annular or concentric manner on the shaft 40 or secured thereto.

In the normal operating state N shown in FIG. 1 in the open position A of the switching device 1, a switching path K between the switch member 4 and counter-contact 5 or switch contact face 4*b* of the switch contact 4*a* and the counter-switch contact face 5*b* is smaller than a travel H' of the switch member 4, which is measured between the safety stop 32 and the retention stop 42 and the travel H of the switch drive 20. The travel H' is generally greater than a drive travel H of the switch drive 20 in order to avoid a situation in which the core 20*b* does not strike the yoke 20*c* when moving from the open position O into a closed position B and consequently the magnetic retention force is reduced by the remaining air gap. A safety distance S is created between the retention stop 42 and the yoke 20*c*. The switching path K, the drive travel H, the travel H' and the safety distance S are all measured in parallel to the switching direction T.

Figure 2:
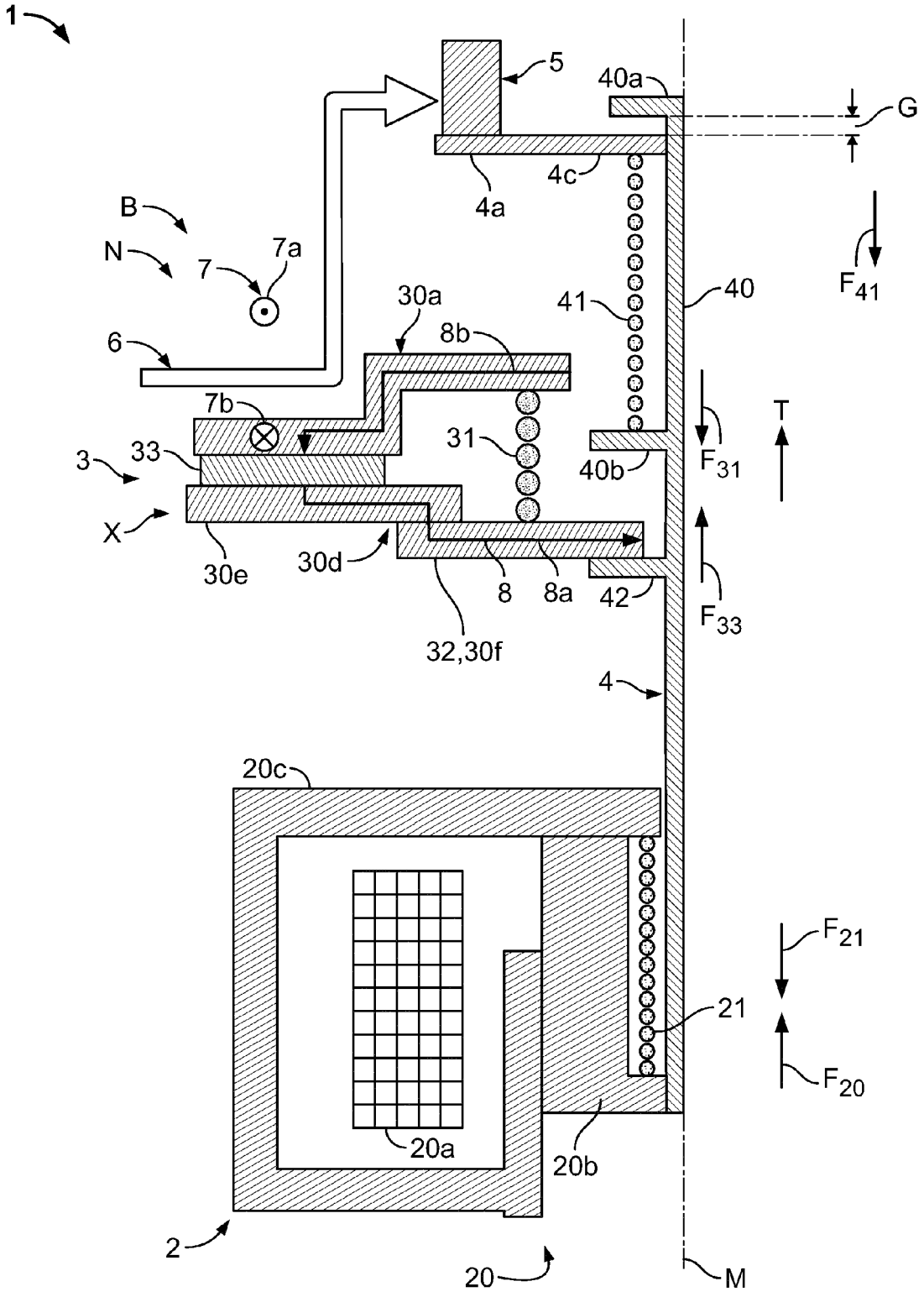
FIG. 2 is a schematic cross-section of the switching device in the normal operating state in the closed position.

FIG. 2 is a schematic cross-section of the switching device 1 in the normal operating state N in the closed position B. The coil 20*a* is excited with a control voltage and has moved the core 20*b* together with the switch member 4 secured thereto in the switching direction T so that the switch contact 4*a* is in abutment with the counter-contact 5. Since the limited travel H or a limited travel H', respectively, is greater than the switching path K, the switch contact arm 4*c* has been raised off the switch stop 40*a* and moved counter to the resilient force $F_{41}$ in the direction of the abutment 40*b* so that, parallel with the switch direction, there is an excess travel G between the switch contact arm 4*c* and the switch stop 40*a*. The closure force $F_{20}$ exceeds the total of the restoring force $F_{21}$ and resilient force $F_{41}$.

Owing to the switch contact 4*a* and counter-contact 5 being brought into contact, a load circuit is closed. As a part of the load circuit, a load current path 6 is formed and may comprise, for example, at least one electrical line. The load current path 6 is partially guided along the first magnet closure portion 30*c* of the safety unit 3 and consequently along the retention magnet 33 and forms an actuating magnetic field 7.

The actuating magnetic field 7 comprises magnetic flux lines 7*a* and 7*b*. The magnetic flux lines 7*a* and in particular the magnetic flux lines 7*b* extend perpendicularly relative to a retaining magnetic field 8 which acts on the retention force $F_{33}$ and which flows from the retention magnet 33 in a first magnetic field portion 8*a* through the other magnet closure portion 30*e* and subsequently the movable yoke portion 30*f* or the safety stop 32 and consequently produces the magnetic retention force $F_{33}$ which retains the safety unit 3 in the release position X. A second magnetic field portion 8*b* flows through the first yoke 30*a* and extends perpendicularly relative to the actuating magnetic field 7 and in particular to the magnetic flux lines 7*b* which consequently have a tendency to weaken the retaining magnetic field 8.

This weakening of the retaining magnetic field 8 is used to weaken the retention force $F_{33}$ in the event of an overload. The retention magnet 33 is constructed in such a manner that the retaining magnetic field 8 and consequently the retention force $F_{33}$ is disrupted in the event of an overload by the actuating magnetic field 7 in such a manner that the separation force $F_{31}$ applied by the separation drive 31 exceeds the sum of the closure force $F_{20}$ and retention force $F_{33}$ (minus the resilient force $F_{41}$ and restoring force $F_{21}$) in order to release the switch contact 4*a* from the counter-contact 5 in an abrupt manner.

Figure 3:
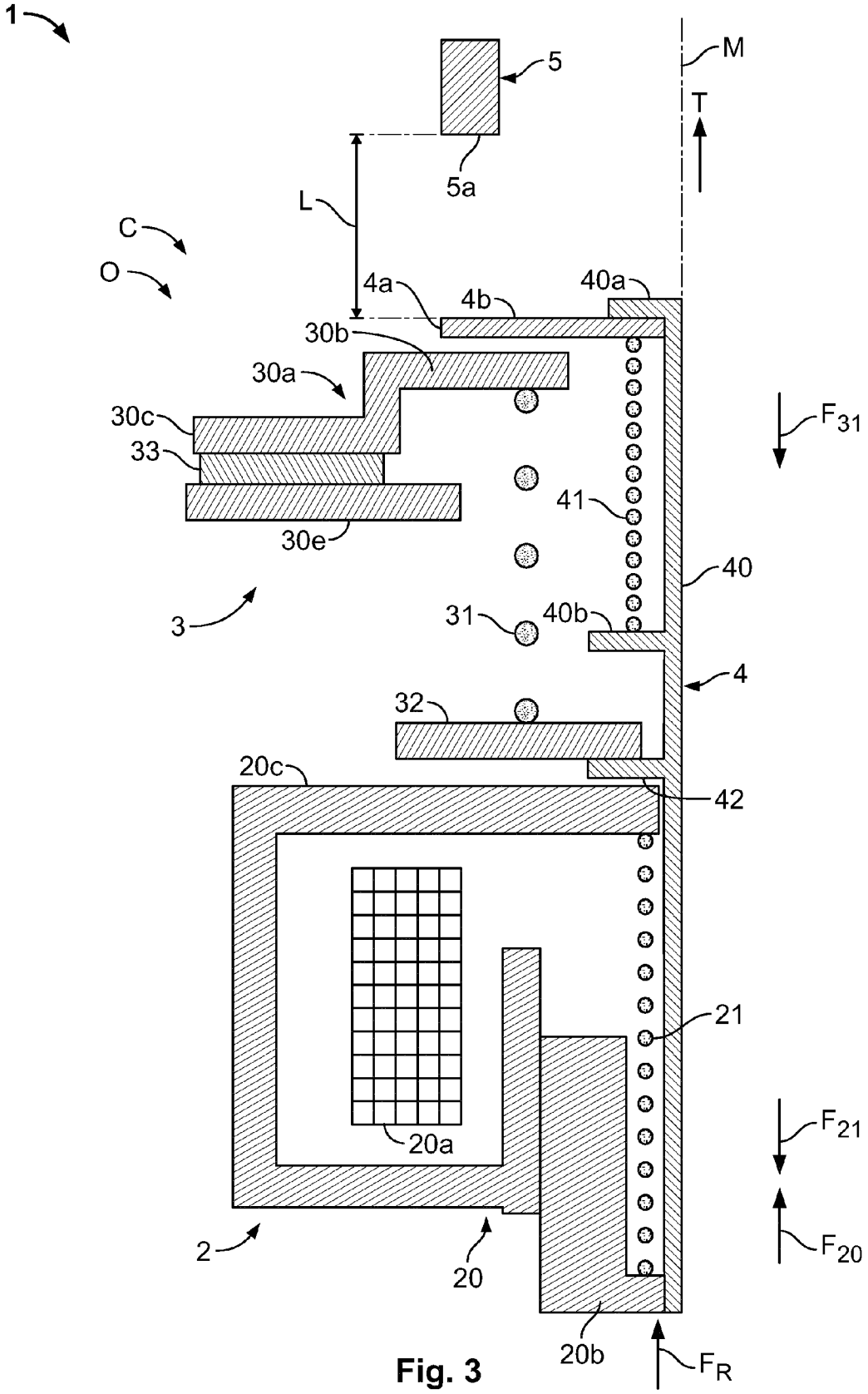
FIG. 3 is a schematic cross-section of the switching device in the safety position.

FIG. 3 is a schematic cross-section of the switching device 1 after the occurrence of an overload O in the safety position C. In the event of an overload O, the separation force $F_{31}$ (in addition to the restoring force $F_{21}$ and the resilient force $F_{41}$) had initially exceeded the total of the closure force $F_{20}$ and retention force $F_{33}$. Consequently, the safety stop 32 has been released from the other yoke 30*d* and completely interrupted the first magnetic field portion 8*a*, whereby all the retention force $F_{33}$ abruptly fell away and the safety stop 32 was thrown counter to the switching direction T. The retention stop 42 which is arranged in the closed position B in the normal operating state N in the switching direction T shortly in front of the safety stop 32 was carried by the retention stop 42 when the stop 42 was thrown out and consequently moved the entire contact member 4 and the switch contact 4*b* which is arranged thereon and separated them abruptly from the counter-contact 5.

By opening the additional yoke 30*d*, the magnetic retention force $F_{33}$ is reduced. In the event of short-term excessive currents or current peaks, the movable yoke portion 30*f* or safety stop 32 may be raised briefly from the other magnet closure portion 30*e*. This applies in particular to currents slightly below an actuation threshold of the safety device 3. The retaining magnetic force $F_{33}$ generally decreases more rapidly than the separation force $F_{31}$ when the additional yoke portion 30*d* is opened. A point for irreversible opening of the additional yoke 30*d* or an actuation point of the safety unit 3 is generally located shortly behind the contact position of the additional magnet closure portion 30*e* and movable yoke portion 30*d* or safety stop 32 in the release position X. The actuation point is exceeded as soon as a sum of the restoring force $F_{21}$, separation force $F_{31}$ and resilient force $F_{41}$ exceeds the retention force $F_{33}$. The safety stop 32 is then moved in an irreversible manner counter to the switching direction T. If the actuation point is not exceeded, the movable yoke portion 30*d* or safety stop 32 again moves back to the additional yoke portion 30*e*.

The switch contact 4*b* is retained with spacing from the counter-contact 5 with a separation spacing L which is measured parallel with the switching direction T and which substantially corresponds to a sum of the switching path K and safety spacing S. The separation force $F_{31}$ (in addition to the restoring force $F_{21}$) is greater than the closure force $F_{20}$ so that only a mechanical intervention from outside the switching device 1 can move the switching device 1 back into the normal operating state N, for example, by the switch member 40 and/or the core 20*b* being moved manually with a resetting force $F_R$ in the switching direction T and the separation force $F_{33}$ (in addition to the restoring force $F_{21}$) being overcome and the safety stop 32 again being brought into contact with the additional magnet closure portion 30*e* in order to close the retaining magnetic field 8 and to move the safety unit 3 back into the release position X.

Within the notion of the invention, variations from the embodiment described above of a switching device 1 according to the invention are possible. Thus, the switching unit 2 and the safety unit 3 can be freely combined with each other in any number in order to switch a desired load current and to bring about an actuation of the safety unit 3 in the event of an overload. To this end, the switching unit may be freely provided with coils 20*a*, cores 20*b* and yokes 20*c* in order to form a switch drive 20, but which may also be constructed as a pneumatic and/or hydraulic drive. The restoring member 21 may be constructed as a spring in accordance with respective requirements, but may also be constructed differently.

The safety unit 3 may be freely provided with a first yoke 30*a*, a support portion 30*b*, a first magnet closure portion 30*c*, another yoke 30*d*, another magnet closure portion 30*e* and a movable yoke portion 30*f* in order to form a retention member 30 with a separation drive member 31. The separation drive member 31 does not necessarily have to be constructed as a resilient element but may instead also be constructed differently in accordance with respective requirements, as long as it is capable of producing a sufficiently large and constantly available separation force $F_{31}$ in order to move the safety device 1 into the safety position C as rapidly as possible and with the shortest possible delay. Accordingly, the safety stop 32 and the retention magnet 33 may be constructed and arranged in accordance with respective requirements. The retention magnet 33 does not necessarily have to be constructed as a magnetic clamp as shown here, but may, for example, also be constructed as an electromagnet.

The switch member 4 may be constructed in accordance with respective requirements with a switch contact 4*a* and the switch contact face 4*b* thereof and a switch contact arm 4*c* on a shaft, for example, as shown here, as a type of tension armature, but may equally well be constructed as a tilting armature. Accordingly, the switch stop 40*a* and abutment 40*b* may be constructed in accordance with respective requirements in order, with the aid of a damping element 41, to damp a striking of the contact member 4 or switch contact 4*a* on the counter-contact 5. The damping element 41 does not necessarily have to be formed as a helical spring as shown herein, but instead may be selected in accordance with respective requirements. The retention stop 42 is intended to be constructed in such a manner that it can ensure a reliable throwing action of the contact member 4 or reliable cooperation with a safety stop 32.

LIST OF REFERENCE NUMERALS

1 Switching unit
2 Switching unit
3 Safety device
4 Switch member (contact bridge)
5 Counter-contact
5*a* Counter-contact face
6 Load current path
7 Actuating magnetic field
7*a*, 7*b* Magnetic flux line
8 Retaining magnetic field
8*a* First magnetic field portion
8*b* Second magnetic field portion
20 Switch drive
20*a* Coil
20*b* Core
20*c* Yoke
30 Restoring member (spring)
30 Retention member
30*a* First yoke
30*b* Support portion
30*c* First magnet closure portion
30*d* Additional yoke
30*e* Additional magnet closure portion
30*f* Movable yoke portion
31 Separation drive member
32 Safety stop
33 Retention magnet
4*a* Switch contact
4*b* Switch contact face
4*c* Switch contact arm
40 Shaft
40*a* Switch stop
40*b* Abutment
41 Damping element
42 Retention stop
$F_{20}$ Switching force/closure force
$F_{21}$ Restoring force
$F_{31}$ Separation force
$F_{33}$ Retention force
$F_{41}$ Damping force
$F_R$ Resetting force
A Open position
B Closed position
C Safety position
G Damping path/excess travel
H Drive travel (maximum)
H' Travel (limited)
K Switching path
L Separation distance
M Centre axis
N Normal operating state
O Occurrence of overload
S Safety distance
T Switching direction
X Release position

The invention claimed is:

1. A switching device for opening and closing a load circuit, in particular in an electric vehicle, having at least one switch contact which can be moved from an open position (A) into a closed position (B) and which is held at a distance from a counter-contact in the open position (A) and is in electrically conductive abutment with the counter-contact in the closed position (B), wherein, in a safety position (C), the at least one switch contact is held separated from the counter-contact in order to protect the load circuit from overload, and wherein the switching device is retained by a retention force in a normal operating state (N) in which the switching device can be moved from the open position into the closed position, and when under electrical voltage in the closed position, at least in the event of an overload, an actuating magnetic field produced by a load current path has a weakening effect on a retaining magnetic field which acts on the retention force.

2. The switching device according to claim 1, wherein, in the open position (A), the at least one switch contact is retained at a distance from the counter-contact over a switching path (K) and in that the switching path (K) is increased by a safety distance (S) in the safety position (C).

3. The switching device according to claim 2, wherein the safety distance (S) is greater than the switching path (K).

4. The switching device according to claim 1, wherein a distance between the at least one switch contact and the counter-contact is greater in the safety position (C) than a distance between the at least one switch contact and the counter-contact necessary for extinguishing an electric arc in the event of a maximum possible overload current in the closed position (B).

5. The switching device according to claim 1, wherein it comprises a safety stop which limits movements of the at least one switch contact in the direction of the counter-contact in the safety position (C).

6. The switching device according to claim 1, further comprising a separation drive, whose separation force ($F_{31}$) in the safety position (C) acts counter to a closure force ($F_{20}$) for moving the at least one switch contact from the open position (A) into the closed position (B).

7. The switching device according to claim 6, wherein the separation force ($F_{31}$) is greater than the closure force ($F_{20}$).

8. The switching device according to claim 6, wherein the separation drive comprises a resilient separation element which at least partially produces the separation force ($F_{31}$).

9. The switching device according to claim 1, further comprising a switching unit for switching between the open position (A) and the closed position (B) and by a safety unit for moving into the safety position (C).

10. The switching device according to claim 9, wherein the safety unit is retained by a magnetic clamp/spring system and/or an electromagnetic coil in a release position (X), in which the switching device can be moved from the open position (A) into the closed position (B).

11. The switching device according to claim 1, wherein a contact member carries the at least one switch contact and a retention stop, the contact member being blocked in the safety position (C) on the retention stop.

12. The switching device according to claim 11, wherein it is constructed at least partially concentrically relative to the contact member.

13. A method for switching a load circuit, in particular in an electric vehicle, at least one switch contact being moved from an open position (A) into a closed position (B) and thereby being brought into electrically conductive contact with a counter-contact, wherein, in the event of an overload of the load circuit, the switch contact is automatically separated from the counter-contact and moved into a safety position (C), and wherein the switching device is retained by a retention force in a normal operation state (N) in which the switching device can be moved from the open position into the closed position, and, when under electrical voltage in the closed position, at least in the event of an overload, an actuating magnetic field produced by a load current path has a weakening effect on a retaining magnetic field which acts on the retention force.

* * * * *